US011000893B2

(12) United States Patent
Dykes et al.

(10) Patent No.: US 11,000,893 B2
(45) Date of Patent: May 11, 2021

(54) SYSTEM AND METHOD FOR CONTINUOUS CASTING

(71) Applicants: Charles D Dykes, Williston, VT (US); Valery G Kagan, Colchester, VT (US); Douglas A Hamilton, Shelburne, VT (US); Casey J Davis, Williamstown, VT (US); John E Pennucci, Colchester, VT (US)

(72) Inventors: Charles D Dykes, Williston, VT (US); Valery G Kagan, Colchester, VT (US); Douglas A Hamilton, Shelburne, VT (US); Casey J Davis, Williamstown, VT (US); John E Pennucci, Colchester, VT (US)

(73) Assignee: HAZELETT STRIP-CASTING CORPORATION, Colchester, VT (US)

( * ) Notice: Subject to any disclaimer, the term of this patent is extended or adjusted under 35 U.S.C. 154(b) by 26 days.

(21) Appl. No.: 15/945,844

(22) Filed: Apr. 5, 2018

(65) Prior Publication Data

US 2018/0290204 A1 Oct. 11, 2018

Related U.S. Application Data

(60) Provisional application No. 62/483,987, filed on Apr. 11, 2017.

(51) Int. Cl.
*B22D 11/06* (2006.01)

(52) U.S. Cl.
CPC ..... *B22D 11/0654* (2013.01); *B22D 11/0605* (2013.01); *B22D 11/0677* (2013.01)

(58) Field of Classification Search
CPC . B22D 11/06; B22D 11/0605; B22D 11/0654; B22D 11/0677

(Continued)

(56) References Cited

U.S. PATENT DOCUMENTS 3,933,193 A 1/1976 Baker et al.
4,061,177 A 12/1977 Sivilotti (Continued)

FOREIGN PATENT DOCUMENTS

FR 1090019 3/1955
FR 1 483 848 A * 6/1967 ..... B22D 11/0605

(Continued)

OTHER PUBLICATIONS

Extended EP Search Report for corresponding EP Appln. 18166456.6 dated Jun. 18, 2018.

(Continued)

*Primary Examiner* — Kevin P Kerns
(74) *Attorney, Agent, or Firm* — Grogan, Tuccillo & Vanderleeden, LLP

(57) ABSTRACT

A continuous casting apparatus includes a first belt carried by a first upstream pulley and a first downstream pulley, a second belt carried by a second upstream pulley and a second downstream pulley, and a mold region defined by a first mold support section arranged behind the first belt and a second mold support section arranged behind the second belt. The first mold support section supports the first belt and defines a shape of the first belt in the mold region and the second mold support section supports the second belt and defines a shape of the second belt in the mold region. At least one of the first mold support section and the second mold support section includes a transition portion and a generally planar portion downstream from the transition portion. The transition portion has a variable radius configured to receive molten metal from a metal feeding device.

18 Claims, 4 Drawing Sheets

(58) Field of Classification Search
USPC ..... 164/429, 430, 431, 432, 479, 481, 463
See application file for complete search history.

(56) References Cited

U.S. PATENT DOCUMENTS

| | | | | |
|---|---|---|---|---|
| 4,061,178 | A | 12/1977 | Sivilotti et al. | |
| 4,505,319 | A | 3/1985 | Tomoaki | |
| 4,582,114 | A | 4/1986 | Sadayuki et al. | |
| 4,635,703 | A | 1/1987 | Nakato et al. | |
| 4,648,438 | A | 3/1987 | Hazelett et al. | |
| 4,673,024 | A * | 6/1987 | Nakato et al. | B22D 11/066 164/431 |
| 4,679,611 | A | 7/1987 | Yoshida et al. | |
| 4,712,602 | A | 12/1987 | Kaiser et al. | |
| 4,735,254 | A | 4/1988 | Itoyama et al. | |
| 4,759,400 | A | 7/1988 | Bessho et al. | |
| 5,725,046 | A | 3/1998 | Sartschev et al. | |
| 5,826,640 | A | 10/1998 | Lauener | |
| 5,900,052 | A | 5/1999 | Nakajima et al. | |
| 5,909,764 | A | 6/1999 | Sartschev et al. | |
| 6,386,267 | B1 | 5/2002 | Kagan | |
| 6,575,226 | B2 | 6/2003 | Kagan | |
| 8,176,970 | B2 | 5/2012 | Ito et al. | |

FOREIGN PATENT DOCUMENTS

| | | | | |
|---|---|---|---|---|
| JP | 51-107232 | | 9/1976 | |
| JP | 51-107235 | | 9/1976 | |
| JP | 57-142748 | | 9/1982 | |
| JP | 59-199151 | | 11/1984 | |
| JP | 64-87046 | | 3/1989 | |
| JP | 1-113155 | A * | 5/1989 | B22D 11/0685 |
| JP | 01-237055 | | 9/1989 | |
| JP | H01-237055 | | 9/1989 | |
| JP | H01-293955 | | 11/1989 | |
| JP | H02112854 | | 4/1990 | |
| SU | 1715475 | | 2/1992 | |

OTHER PUBLICATIONS

International Search Report from related PCT/US2018/26197 dated Jun. 19, 2018.
Russian Office Action and Search Report issued in related Russian Patent Application No. 2019130895 dated Apr. 13, 2020.
Japanese Office Action issued in related Japanese Patent Application No. 2019-553856 dated Apr. 1, 2020.
Korean Office Action issued in related Korean Patent Application No. 10-2019-7032885 dated May 7, 2020.
Search Report from corresponding Chinese Application No. 2018103211337 dated Sep. 18, 2020.
Miaoyong, Zhu, Modern Metallurgical Technology—Iron and Steel Metallurgy Volume (2nd Edition), Dec. 31, 2016, p. 486.
English Translation of Corresponding Korean Office Action dated Nov. 26, 2020.
English Translation of Corresponding Japanese Office Action dated Oct. 27, 2020.

* cited by examiner

SYSTEM AND METHOD FOR CONTINUOUS CASTING

CROSS-REFERENCE TO RELATED APPLICATIONS

This application claims the benefit of U.S. Provisional Application Ser. No. 62/483,987, filed on Apr. 11, 2017, which is hereby incorporated by reference herein in its entirety.

FIELD OF THE INVENTION

The present invention relates generally to continuous casting of metals and, more particularly, to a twin belt casting system and method for continuous casting of metals.

BACKGROUND OF THE INVENTION

Continuous casting of light metal alloys such as, for example, aluminum alloys, has typically been performed in continuous casters, such as twin roll casters and twin belt casters. Twin roll casters generally include a pair of opposed, rotating rolls against which molten metal is fed. The centerlines of the rolls are in a vertical or generally vertical plane that passes though a region of minimum clearance between the rolls, referred to as the "nip", such that the cast strip forms in a generally horizontal path, although other twin roll casting apparatuses exist that produce strips in an angled or vertical direction.

As shown in FIG. 1, twin belt casters, on the other hand, such as twin belt casting apparatus 10, generally include a pair of endless belts 12, 14 carried by a pair of upper pulleys 16, 18 and a corresponding pair of lower pulleys 20, 22. (Pulleys 16 and 20 are also referred to herein as nip pulleys or nip rolls. Pulleys 18 and 22 are also referred to herein as downstream pulleys or downstream rolls.) The arrangement of the nip rolls 16, 18 and 20, 22 one above the other defines a mold zone, A, bounded by the belts 12, 14. The gap between the belts 12, 14 determines the thickness of the cast strip 24. Molten metal 26 fed directly via a feeding apparatus 28 having a nozzle 30 into the nip is confined between the moving belts 12, 14 and is solidified as it is carried along. Heat from the solidifying metal is withdrawn into the portions of the belts 12, 14 which are adjacent to the metal being cast by various means known in the art.

While existing twin roll casting systems and twin belt casting systems are generally suitable for what can be regarded as ordinary performance, improvements in terms of minimum strip thickness and metallurgical quality, including surface quality, are desired without sacrificing productivity. For example, with twin roll casting, where metal is cast against the opposed nip rolls, the length of the mold is limited to a short distance prior to the tangent point of the opposed rolls, the diameters of which are limited by practical considerations such as the space that must be made available for the feeding apparatus. These upper limits on the diameter and circumference of the rolls limits casting speed, roll life and metallurgical quality.

With twin belt casting, as discussed above, molten metal is typically fed onto the belt at or just after the tangent point where the belts transition from the curved path defined by the nip rolls or pulleys to the planar path of the mold region. Although the belts allow for an extended mold length as compared to twin roll casting, initial solidification occurs in the zone immediately following the nip, where the belts are the most unstable. In particular, with reference to FIG. 2, a phenomenon known as belt "take-off" can occur in this zone 34 (referred to as belt take-off zone) as the belt 14 transitions from a curved path of travel around the nip roll 20 to a planar path of travel in the mold zone where the belts 12, 14 are supported by backup rolls 32. As used herein, "belt take-off" refers to the natural tendency of a tensioned belt to come away from its radiused or planar guide surface when subjected to a bending moment or other force. As will be readily appreciated, metallurgical quality may be negatively impacted in regions of belt instability, such as in this zone immediately following the nip, particularly when casting alloys having broad freezing ranges.

Moreover, in twin belt casting, wherein molten metal is fed into the substantially parallel section of the mold, casting thicknesses are also confined to thicker sections, typically over 15 millimeters thick. Accordingly, additional post-casting operations such as rolling are often required to achieve thicknesses less than 15 millimeters, which increases overall cost. In addition, the solidification of the internal layers of these relatively thick cast sections is slowed considerably by the thermal resistance of the surface layers, which can be particularly detrimental when casting alloys having a broad freezing range.

In view of the above, there is a need for a system and method for twin belt continuous casting of metals that enables thinner metal strips to be produced and achieves improved metallurgical quality, including surface quality, of the cast strip than has heretofore been possible with existing systems and apparatuses, without sacrificing productivity.

SUMMARY OF THE INVENTION

It is an object of the present invention to provide a twin belt continuous casting apparatus.

It is another object of the present invention to provide a twin belt continuous casting apparatus that improves heat transfer rates throughout the thickness of the cast strip as compared to existing apparatuses.

It is another object of the present invention to provide a twin belt continuous casting apparatus that produces thinner metal strips than has heretofore been possible.

It is another object of the present invention to provide a twin belt continuous casting apparatus that improves metallurgical quality, including surface quality, of the cast strip.

It is another object of the present invention to provide a twin belt continuous casting apparatus that facilitates the use of thicker belts than has heretofore been possible.

It is another object of the present invention to provide a method for twin belt continuous casting that minimizes belt take-off.

It is another object of the present invention to provide a method for twin belt continuous casting that enables the production of strips less than about 7 millimeters in thickness.

It is another object of the present invention to achieve the above objectives without sacrificing productivity.

These and other objects are achieved by the present invention.

According to one embodiment of the present invention, a continuous casting apparatus for casting a metal strip is provided. The continuous casting apparatus includes a first belt carried by a first upstream pulley and a first downstream pulley, a second belt carried by a second upstream pulley and a second downstream pulley, and a mold region into which molten metal is supplied, the mold region being defined by a first mold support section arranged behind the first belt intermediate the first upstream pulley and the first downstream pulley and a second mold support section arranged behind the second belt intermediate the second upstream pulley and the second downstream pulley. The first mold support section supports the first belt and defines a shape of the first belt in the mold region and the second mold support section supports the second belt and defines a shape of the second belt in the mold region. At least one of the first mold support section and the second mold support section includes a transition portion and a generally planar portion downstream from the transition portion. The transition portion has a variable radius configured to receive molten metal from a metal feeding device.

According to another embodiment of the present invention, a method for continuous casting a metal strip is provided. The method includes arranging a first belt on a first upstream pulley and a first downstream pulley, arranging a second belt on a second upstream pulley and a second downstream pulley, forming a mold region by arranging a first mold support section behind the first belt intermediate the first upstream pulley and the first downstream pulley and arranging a second mold support section behind the second belt intermediate the second upstream pulley and the second downstream pulley, at least one of the first mold support section and the second mold support section having a curved transition portion downstream from the first upstream pulley and the second upstream pulley, and a generally planar portion downstream from the curved transition portion, and feeding molten metal onto the curved transition portion.

According to yet another embodiment of the present invention, a continuous casting apparatus for casting a metal strip is provided. The continuous casting apparatus includes a first belt carried by a first upstream pulley and a first downstream pulley, a second belt carried by a second upstream pulley and a second downstream pulley, and a mold region defined by a first mold support section arranged behind the first belt intermediate the first upstream pulley and the first downstream pulley and second mold support section arranged behind the second belt intermediate the second upstream pulley and the second downstream pulley. The mold region includes a first zone, a second zone downstream from the first zone, and a third zone downstream from the second zone.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENT

Figure 1:
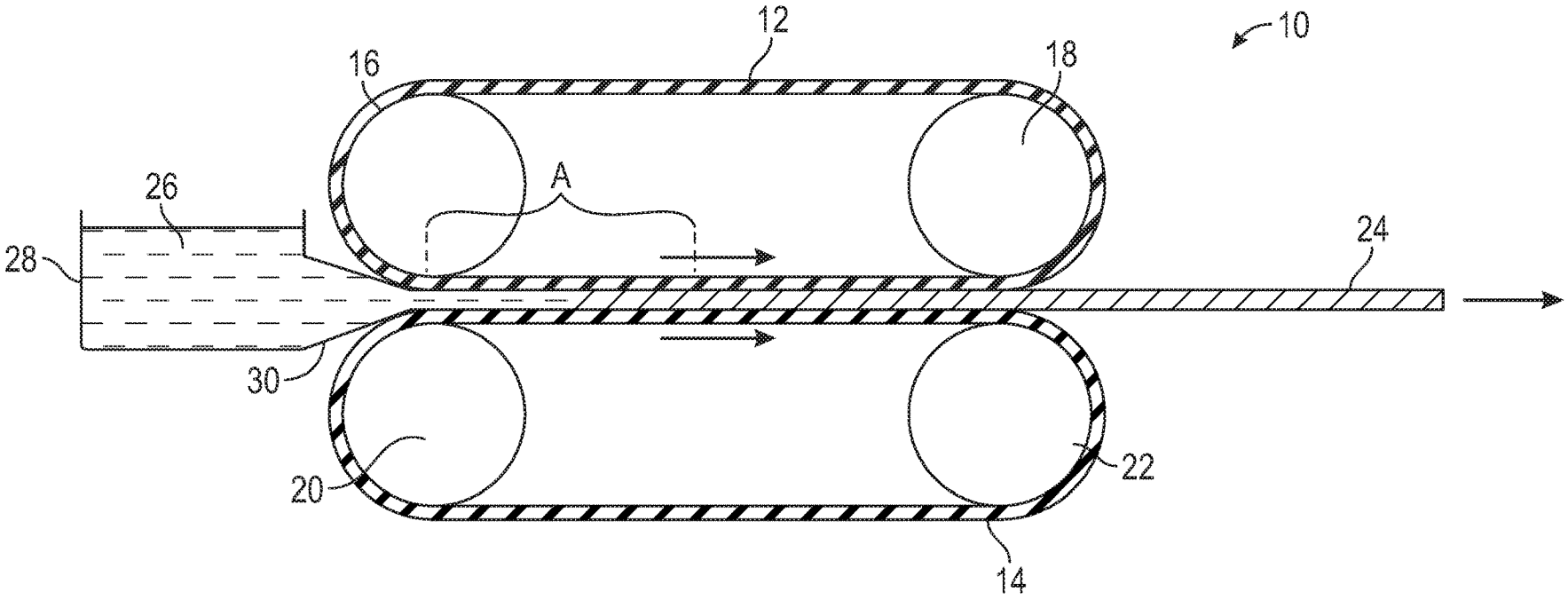
FIG. 1 (Prior Art)
FIG. 1 is a simplified schematic illustration of a prior art twin belt caster.
Figure 2:
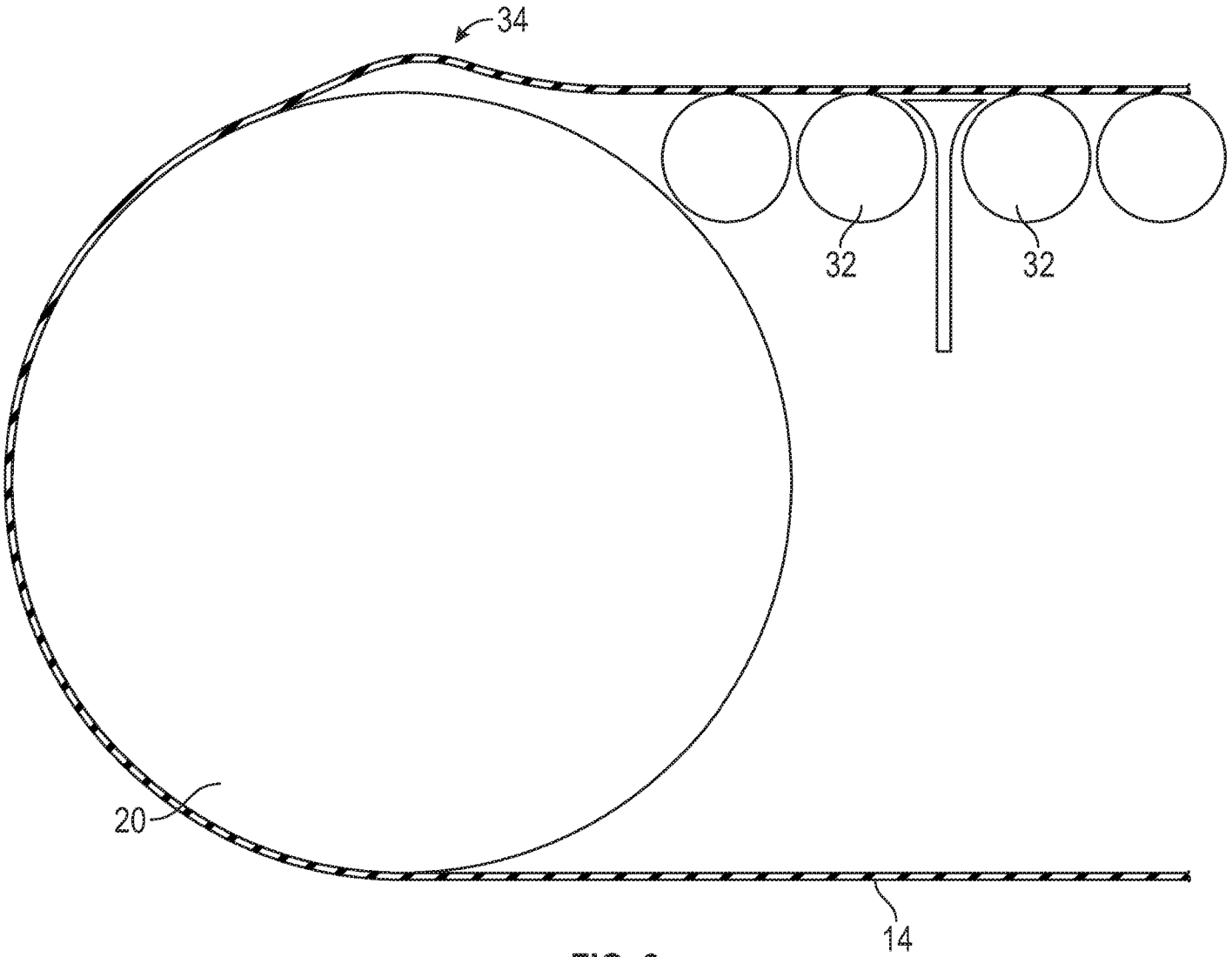
FIG. 2 (Prior Art)
FIG. 2 is a detailed, schematic illustration of a portion of a prior art twin belt caster, illustrating the phenomenon of belt take-off in a mold zone of the caster.
Figure 3:
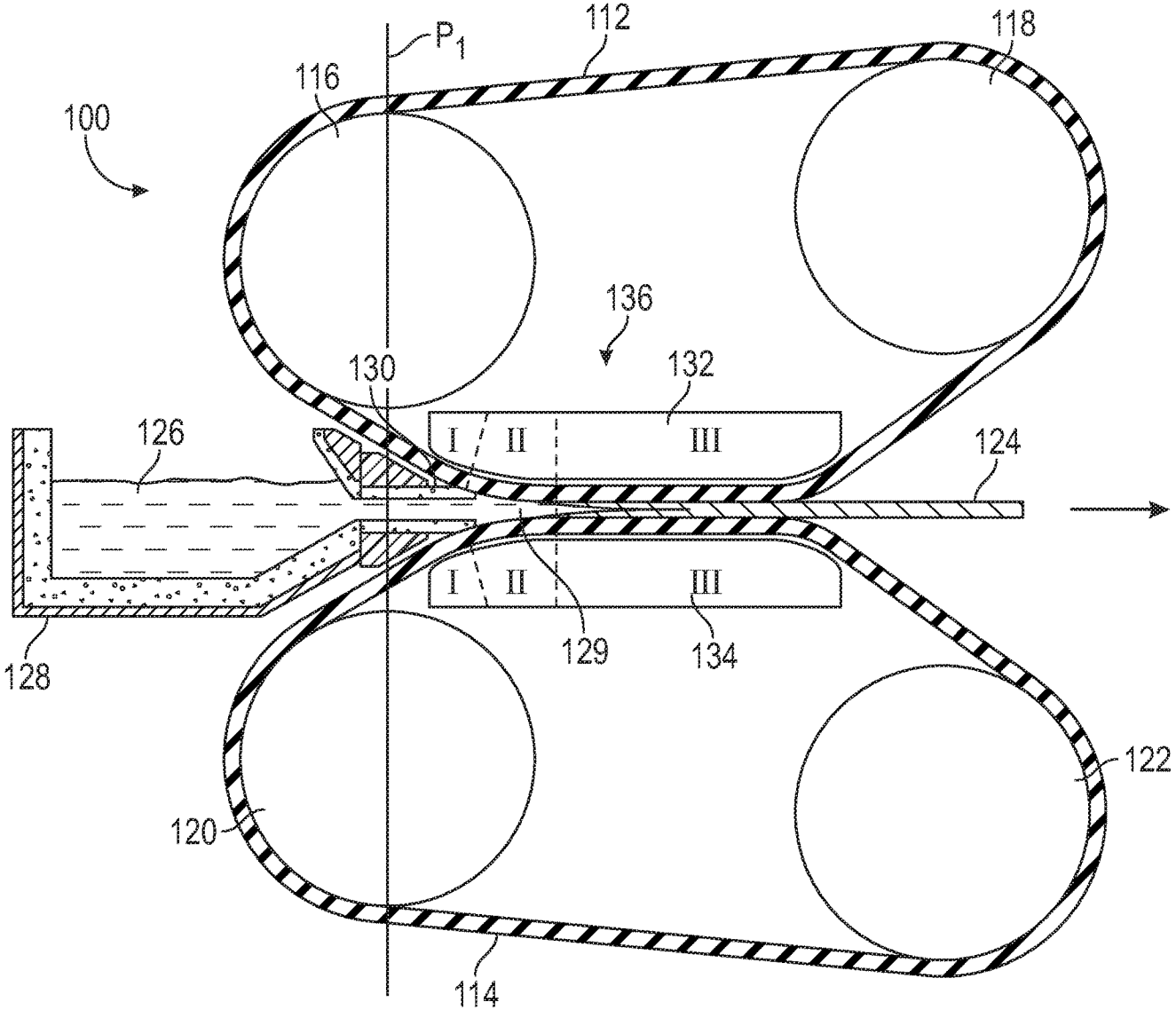
FIG. 3 is a simplified schematic illustration of a twin belt casting apparatus according to an embodiment of the present invention.

Referring to FIG. 3, a twin belt casting apparatus 100 according to an embodiment of the present invention is illustrated. As shown therein, the casting apparatus 100 includes a first endless belt 112 carried by a first upstream pulley or roll 116 and a first downstream pulley or roll 118, and a second endless belt 114 carried by a second upstream pulley or roll 120 and a second downstream pulley or roll 122. Each roll is mounted for rotation about its longitudinal axis and serves to rotate, guide and/or tension the belts 112, 114. Either or both of the upper rolls 116, 118 and the lower rolls 120, 122 may be driven by a suitable motor (not shown). The belts 112, 114 are endless and are preferably formed of a metal which has low reactivity or is non-reactive with the metal being cast. As illustrated in FIG. 3, the upstream rolls 116, 120 are positioned one above the other, some distance apart to allow room for a metal feeding apparatus 128 to be positioned in the space, and define a plane $P_1$ extending through the respective tangents of the rolls 116, 120.

Molten metal 126 to be cast is supplied through the feeding apparatus 128 having a nozzle 130 located so as to deliver a horizontal stream of molten metal at a point 129 downstream from the plane $P_1$ into the mold region of the apparatus 100, as discussed in detail hereinafter. In an embodiment, an edge containment means that eliminates the need for travelling edge dam blocks may be employed to contain the molten metal at the mold entry and/or throughout the mold region. For example, stationary edge dams located between the first and second belts 112, 114 may be employed to effectuate side containment of the molten metal adjacent to first, second and/or third zones of a mold region of the apparatus, as discussed hereinafter.

As further shown in FIG. 3, the casting apparatus also includes a pair of opposed mold support sections 132, 134 located along the path of the moving belts 112, 114, which support the belts 112, 114, respectively, and define at least a portion of the path of travel of the moving belts 112, 114. The mold support sections 132, 134 define therebetween a mold region 136 downstream from $P_1$. Importantly, the mold region 136 is formed by separate mold support sections 132, 134 located distal from and approximately mid-way between the upstream rolls 116, 120 and the downstream rolls 118, 122, rather than in close proximity to the nip rolls 116, 120. As discussed hereinafter, one or both of the mold support sections 132, 134 may include curved sections of large radii that support the belts 112, 114 upon which the molten metal 126 is fed. This configuration allows a belt, even when lightly tensioned about the mold support sections 132, 134, to inherently exert an effective hold-down force that conforms the belt shape to the shape of the curved mold support sections 132, 134. While the embodiments herein show the supporting structure that supports the moving belts and defines the shape of the moving belts in the mold region 136 as solid "mold support sections" other supporting devices such as an array of backup rolls or platens may also be utilized to define the support the moving belts 112, 114 and define the shape of the moving belts 112, 114 in the mold region 136 the without departing from the broader aspects of the present invention.

Figure 4:
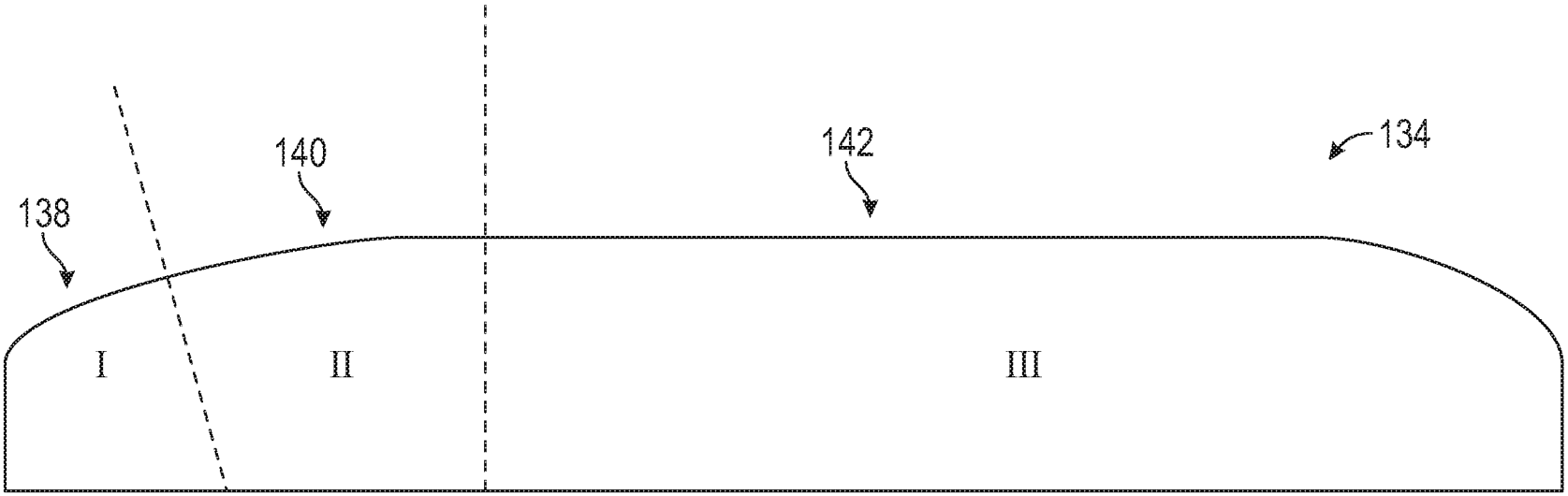
FIG. 4 is an enlarged, detail view of a mold support section of the twin belt casting apparatus of FIG. 3, according to an embodiment of the present invention.

With reference to FIG. 4, one or both of the mold support sections 132, 134 may include a first, small radius portion 138 defining a first zone (Zone I) of the belt pass, a second, large radius transition portion 140 adjoining the small radius portion 138 and defining a second zone (Zone II) of the belt pass, and a third, substantially planar portion 142 adjoining the large radius portion 140 and defining a third zone (Zone III) of the belt pass. In an embodiment, the small radius portion 138 and the large radius portion 140 may have a radius from about 0.4 meters to about 1.5 meters, where the large radius portion 140 has a radius that is different from, and larger than a radius of the small radius portion 138. In an embodiment, the small radius portion 138 may have a constant or variable radius of curvature from about 0.3 meters to about 1 meter, and the large radius portion 140 may have a constant or variable radius of curvature from about 0.5 meters to about 25 meters. In an embodiment, the large radius portion 140 may have a radius of curvature that increases (as slope decreases) progressively from the small radius portion 138 to the planar portion 142 (i.e., a variable or changing radius of curvature). In an embodiment, the large radius portion 140 defining Zone II of the belt pass may have a radius of curvature that changes continuously from the upstream end to the downstream end.

Importantly, the presence of a large radius portion or section 140 (i.e., Zone II) near the transition to the planar portion or section 142 of the mold 136 eliminates or substantially reduces the possibility of belt take-off at the tangent of the comparatively small, fixed-radius roll 120 (or its equivalent) where the belt transitions from a curved to planar path, and at least separates the mold entry point 129 where molten metal is first supplied away from any area of the apparatus 100 where belt take-off is possible. Furthermore, the geometry of the curved portions of the mold support sections 132, 134 functions to support the belt 114 (or 112) in what has heretofore been the unsupported belt take-off region 34. As a result, the very stable nature of this mold entry region (including mold entry point 129) where the molten metal is fed allows casting at thicknesses that are as much as an order of magnitude thinner than is typically possible on existing twin belt casters. For example, the configuration of the twin belt casting apparatus 100 of the present invention allows for the casting of thin cast sections under approximately 7 millimeters thick and, more preferably under approximately 5 millimeters thick, which has heretofore not successfully achieved on existing twin belt casting apparatuses.

Moreover, the small radius portion 138 (Zone I) preceding the large radius portion 140 (Zone II) accommodates the metal feeding apparatus 128 and associated supporting structures.

Zone III, defined by the planar portion 142 of the mold support sections 132, 134, for its part, performs the functions of mold forces control, cooling control, and belt-stabilization from thermo-mechanical forces.

In an embodiment, the radius of the respective zones of the mold support sections 132, 134 may be based on a mathematical function such as a parabola, hyperbola or other higher order functions. In an embodiment, concatenating several sections may include bringing different forms together in a tangential manner, utilizing variable radiuses, continuous radiuses, and intermittent straight sections. In an embodiment, the shape and contour of the mold support sections 132, 134 may be designed to match the natural contour of the belt in the belt take-off zone 34 during operation (which may be dependent upon the level of heat input, speed/dynamics, tension level, belt thickness, belt material, alloy/solidification nuances, etc). In certain embodiments, the mold 136 may be constructed so that its physical shape may be varied while casting metal or in-between casting campaigns. In an embodiment, the upper mold support section 132 may have a shape, contour or configuration that is different than the lower mold support section 134.

It is further contemplated that the radius of the converging belts 112, 114 may be increased or decreased (by increasing or decreasing the radius of the radiused portion 138 of the mold support sections 132, 134) to accommodate moving the solidification zone further into the apparatus 100 or bring it closer to the metal feeding tip 130. In an embodiment, the generally parallel, planar portion of the mold 136, defined by the opposed planar portions 142 of the mold support sections 132, 134, could be tapered slightly and adjusted as needed to provide even cooling from both belts as the strip 124 shrinks without inducing hot-work to the cooling metal. In an embodiment, the upper or lower mold support section 132, 134 may be spring loaded or otherwise biased towards the other of the upper of lower mold support section (e.g., mechanical, fluid, electric, etc.). The exit end of the mold could also be adjusted to shorten or lengthen the effective cooling region of the casting apparatus 100 without having to alter casting speed.

In connection with the above, in operation, molten metal 126 is fed onto the belts 112, 114 in a zone where the tensioned belts, supported on a comparatively large radius by means other than by nip rolls, are converging. For example, in an embodiment, the molten metal 126 is fed onto the large radius portion of the belt path defined by large radius portion 140 (Zone II) of the mold support sections 132, 134. The combination of belt tension and the curvature of the belt provided by the supporting profile of the mold support sections 132, 134 provides a very stable belt condition in the zone where initial solidification occurs. Thinner strips may therefore be cast at higher solidification rates, achieving metallurgical improvements compared to existing twin belt casting machines, especially for broad freezing range alloys. In addition, the ability to cast thinner strips reduces or eliminates the requirement for subsequent rolling to finished gauge, which reduces both capital and operating costs.

In addition to the above-described benefits, the casting apparatus 100 of the present invention also enables the use of much thicker casting belts as compared to the casting belts utilized on existing belt casters with comparatively small, fixed-diameter nip pulleys or their equivalent. In particular, practical belt thicknesses are limited by the minimum radii that it must conform to under tension. Generally, this means that the diameter of the pulleys (or their equivalent) on belt casting machines must be approximately 400-600 times the thickness of a high-strength low alloy steel belt at ambient temperatures. Any smaller a ratio and the outer fibers of the belt can be stressed beyond their yield point. For a 1.2 millimeter thick belt, this translates to a pulley diameter of 600 millimeters (0.6 meters). Under conditions of high heat transfer, the outer fibers of the steel belt are further stressed, requiring even larger pulley radii.

By utilizing mold support sections 132, 134 having a large radius portion 140, and feeding onto such large radius portion 140 rather than the smaller radius pulley or nip rolls, thicker belts may be utilized than has heretofore been possible. This is particularly desirable because thicker belts have a higher heat capacity and promote higher heat transfer rates, which are helpful particularly when casting broad freezing range alloys. By combining thin cast sections, e.g., less than about 7 millimeters thick, while utilizing thick belts, e.g., approximately 2 millimeters or more, heat transfer rates of an order of magnitude greater than are typical on existing belt casters can be achieved while maintaining belt stability. In an embodiment, the belts may be in the range of about 1-4 millimeters thick. This, in turn, allows very broad freezing range alloys to be cast on twin belt casters at high production rates, with superior metallurgical and surface qualities.

In addition to the advantages described above, utilizing the mold support sections 132,134 to support the moving belts and to form the mold region 136 downstream from the upstream pulleys allows the belts to expand and contract on the essentially frictionless supporting mold support sections. This is in stark contrast to existing devices where expanding and contracting of the moving belts on the rotating entrance/upstream pulleys can contribute to instability. Indeed, the present invention essentially separates the mold region 136 from the upstream pulleys or rolls which drive the belts.

While the embodiments described above disclose that the mold sections 132, 134 include first and second radiused portions that lead to a generally planar portion, it is contemplated that the mold sections 132, 134 may alternatively be formed with a single curved or radiused portion upstream from the generally planar portion onto which the molten metal is fed. In an embodiment, this radiused, transition portion may have a radius that increases progressively from an upstream end of the mold section to the planar portion of the mold section. In yet other embodiments the mold sections 132, 134 may have more than two distinct radiused or curved portions, either with constant or variable radius, such as three, four, five, or more radiused portions leading up to the generally planar portion.

In connection with the above, certain combinations of thicker belts and thinner cast strips allow for the use of the natural thermal capacitance of the belt as a conductive cooling means at levels considerably higher than that experienced in existing casting systems, which allows for more rapid solidification of the cast strip. In prior art systems, heat is actively removed from the belt in, and proximate to, the mold zone due to the limited proportion of thermal capacity of thinner belts (e.g., about less than ~1.2 millimeters) with respect to thicker strips (e.g., in excess of about 15 millimeters). Conversely, a more advantageous proportion of thermal capacity is offered by thicker belts (up to about 4 millimeters) casting thinner strips (between about 2-6 millimeters), as contemplated by the present invention, which enables belt thermal conduction to more rapidly accomplish initial solidification of the cast strip. Accordingly, heat removal from the belt may then be accomplished either by a combination of belt cooling both proximate to and remote from the mold region, or entirely remote from the mold region.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A continuous casting apparatus for casting a metal strip, comprising:

a first belt carried by a first upstream pulley and a first downstream pulley;

a second belt carried by a second upstream pulley and a second downstream pulley; and a mold region into which molten metal is supplied, the mold region being defined by a first mold support section arranged behind the first belt intermediate the first upstream pulley and the first downstream pulley, and a second mold support section arranged behind the second belt intermediate the second upstream pulley and the second downstream pulley;

wherein the first mold support section supports the first belt and defines a shape of the first belt in the mold region;

wherein the second mold support section supports the second belt and defines a shape of the second belt in the mold region;

wherein at least one of the first mold support section and the second mold support section includes a transition portion and a planar portion downstream from the transition portion; and wherein the transition portion is located upstream from the planar portion and is configured to receive molten metal from a metal feeding device, the transition portion having a radius that increases progressively throughout its extent from an upstream end of the transition portion to the planar portion, and wherein the planar portion forms a tapered section of the mold region intermediate the first mold support section and the second mold support section.

2. The continuous casting apparatus of claim 1, wherein:

the at least one of the first mold support section and the second mold support section further includes a first radiused portion;

wherein the transition portion is located intermediate the first radiused portion and the planar portion; and wherein the transition portion has a larger radius than the first radiused portion over an entire extent of the transition portion from a point adjacent to the first radiused portion to a point adjacent to the planar portion.

3. The continuous casting apparatus of claim 2, wherein:

the radius of the first radiused portion is variable.

4. The continuous casting apparatus of claim 1, wherein:

the radius of the first radiused portion is from about 0.3 meters to about 1 meter.

5. The continuous casting apparatus of claim 4, wherein:

the radius of the transition portion is from about 0.5 meters to about 25 meters.

6. The continuous casting apparatus of claim 1, wherein:

the first belt and the second belt each have a thickness of between about 1 millimeter to about 4 millimeters.

7. The continuous casting apparatus of claim 6, wherein:

the metal strip has a thickness less than about 7 millimeters.

8. The continuous casting apparatus of claim 6, wherein:

the metal strip has a thickness less than about 5 millimeters.

9. The continuous casting apparatus of claim 1, wherein:

the continuous casting apparatus is a horizontal continuous casting apparatus, such that the second mold support section is arranged vertically above the first mold support section, the first and second mold support sections defining therebetween the mold region which extends horizontally.

10. The continuous casting apparatus of claim 1, wherein:

the first mold support section and the second mold support section directly support the first belt and the second belt, respectively.

11. The continuous casting apparatus of claim 1, wherein:

the transition portion and the planar portion define a continuous surface of the least one of the first mold support section and the second mold support section for supporting the first belt or the second belt; and the planar portion of the at least one of the first mold support section and the second mold support section that forms the tapered section of the mold region is a continuous surface of the at least one of the first mold support section and the second mold support section.

12. A method for continuous casting a metal strip, comprising the steps of:

arranging a first belt on a first upstream pulley and a first downstream pulley;

arranging a second belt on a second upstream pulley and a second downstream pulley;

forming a mold region by arranging a first mold support section behind the first belt intermediate the first upstream pulley and the first downstream pulley, and arranging a second mold support section behind the second belt intermediate the second upstream pulley and the second downstream pulley, each of the first mold support section and the second mold support section having a curved transition portion downstream from the first upstream pulley and the second upstream pulley, and a planar portion downstream from the curved transition portion, whereby the opposed planar portions of the first mold support section and the second mold support section are arranged so as to define a tapered portion of the mold; and feeding molten metal onto the curved transition portion;

wherein the at least one of the first mold support section and the second mold support section further includes a first radiused portion;

wherein the curved transition portion is located intermediate the first radiused portion and the planar portion;

wherein the curved transition portion is located downstream from a plane extending through a tangent of the first upstream pulley and the second upstream pulley;

wherein the curved transition portion has a radius that increases progressively moving from an upstream end of the curved transition portion to the planar portion.

13. The method according to claim 12, wherein:

the radius of the curved transition portion is from about 0.5 meters to about 25 meters.

14. The method according to claim 13, wherein:

the radius of the first radiused portion is from about 0.3 meters to about 1 meter.

15. A continuous casting apparatus for casting a metal strip, comprising:

a first belt carried by a first upstream pulley and a first downstream pulley;

a second belt carried by a second upstream pulley and a second downstream pulley; and a mold region defined by a first mold support section arranged behind the first belt intermediate the first upstream pulley and the first downstream pulley and a second mold support section arranged behind the second belt intermediate the second upstream pulley and the second downstream pulley;

wherein the mold region includes a first zone, a second zone downstream from the first zone, and a third zone downstream from the second zone;

wherein the first mold support section includes a planar portion forming a first portion of the third zone;

wherein the second mold support section includes a planar portion forming a second portion of the third zone;

wherein the first and second portions of the third zone form a tapered section of the mold region intermediate the first mold support section and the second mold support section to maintain contact between opposed sides of the metal strip and the first belt and the second belt, respectively, as the metal strip cools and shrinks while moving through the third zone; and wherein the radius of curvature of the second zone increases progressively from an upstream end of the second zone to a downstream end of the second zone.

16. The continuous casting apparatus of claim 15, wherein:

the first zone has a constant radius of curvature.

17. The continuous casting apparatus of claim 16, wherein:

the radius of the first zone is between about 0.3 meters and about 1 meter.

18. The continuous casting apparatus of claim 17, wherein:

the radius of the second zone is between about 0.5 meters to about 25 meters.

* * * * *